US012595030B2

(12) United States Patent
Kubota et al.

(10) Patent No.: US 12,595,030 B2
(45) Date of Patent: Apr. 7, 2026

(54) HULL-MOUNTED INSTALLATION CONVERSION METHOD

(71) Applicant: KAWASAKI JUKOGYO KABUSHIKI KAISHA, Kobe (JP)

(72) Inventors: Tetsuya Kubota, Kobe (JP); Tomoki Kuwabara, Kobe (JP); Yasuyuki Haneda, Kobe (JP); Susumu Ikeda, Kobe (JP); Minoru Yokoyama, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 714 days.

(21) Appl. No.: 17/917,353

(22) PCT Filed: Apr. 16, 2021

(86) PCT No.: PCT/JP2021/015690

§ 371 (c)(1),
(2) Date: Oct. 6, 2022

(87) PCT Pub. No.: WO2021/215359

PCT Pub. Date: Oct. 28, 2021

(65) Prior Publication Data

US 2023/0150624 A1 May 18, 2023

(30) Foreign Application Priority Data

Apr. 22, 2020 (JP) ..... 2020-076292
Jul. 28, 2020 (JP) ..... 2020-126926

(51) Int. Cl.
*B63B 73/20* (2020.01)
*B63B 73/40* (2020.01)

(52) U.S. Cl.
CPC ..... *B63B 73/20* (2020.01); *B63B 73/40* (2020.01)

(58) Field of Classification Search
CPC ..... B63B 73/20; B63B 73/40; B63B 83/20; B63B 15/00; B63B 29/00
USPC ..... 114/65 R
See application file for complete search history.

(56) References Cited

U.S. PATENT DOCUMENTS 10,207,552 B2 * 2/2019 Brummel ..... B60T 7/20
10,538,388 B2 * 1/2020 Clarke ..... E04B 2/7403

FOREIGN PATENT DOCUMENTS

| | | | |
|---|---|---|---|
| CN | 205292988 | U | 6/2016 |
| CN | 205569455 | U | 9/2016 |
| JP | S62-184990 | A | 8/1987 |
| JP | H06-122392 | A | 5/1994 |
| JP | 2002-068078 | A | 3/2002 |
| JP | 2002-362478 | A | 12/2002 |
| JP | 2018-176945 | A | 11/2018 |
| WO | 2017/090357 | A1 | 6/2017 |

* cited by examiner

*Primary Examiner* — Daniel V Venne
(74) *Attorney, Agent, or Firm* — OLIFF PLC

(57) ABSTRACT

A hull-mounted installation conversion method in which some or all of first-use units placed on a hull and constituting a first-use installation are removed from the hull, and then second-use units are placed on the hull to construct a second-use installation. For example, the first-use units are medical units, and the first-use installation is a medical installation. Alternatively, the second-use units are medical units, and the second-use installation is a medical installation.

9 Claims, 7 Drawing Sheets

HULL-MOUNTED INSTALLATION CONVERSION METHOD

CROSS-REFERENCE TO RELATED APPLICATIONS

This is a U.S. National Phase Application of PCT/JP2021/015690 filed on Apr. 16, 2021, which designates the United States and claims priority to Japanese Patent Application Nos. 2020-076292 and 2020-126926, filed Apr. 22, 2020, and Jul. 28, 2020, respectively, the entire contents of which are incorporated herein by reference.

TECHNICAL FIELD

The present disclosure relates to a hull-mounted installation conversion method.

BACKGROUND ART

It is conventional practice to remodel an existing ship for one purpose into a ship for another purpose. Examples of the existing ship to be remodeled include various types of transport ships (such as a petroleum tanker).

CITATION LIST

Patent Literature

PTL 1: Chinese Utility Model No. 205569455

SUMMARY OF INVENTION

Technical Problem

For example, in the case of remodeling a petroleum tanker into a luxury cruise ship, their hull structures are completely different. Thus, remodeling of the petroleum tanker into the luxury cruise ship involves cost and time comparable to those required for building of a new ship. From this perspective, it is conceivable to convert an installation on a hull without changing the hull itself significantly.

Patent Literature 1 describes placing medical units on a hull and constructing a medical installation to build a hospital ship. However, Patent Literature 1 fails to describe constructing another installation in place of the medical installation or constructing the medical installation in place of an installation other than the medical installation.

It is therefore an object of the present disclosure to provide a hull-mounted installation conversion method capable of remodeling a ship at a low cost and in a short period of time.

Solution to Problem

In order to solve the problem described above, a hull-mounted installation conversion method of the present disclosure includes: removing some or all of first-use units from a hull, the first-use units being placed on the hull and constituting a first-use installation; and placing second-use units on the hull to construct a second-use installation after the removing of the first-use units.

With the above configuration, the first-use installation can be converted into the second-use installation by replacing some or all of the first-use units with the second-use units. Thus, a ship can be remodeled at a low cost and in a short period of time.

Advantageous Effects of Invention

According to the present disclosure, a ship can be remodeled at a low cost and in a short period of time.

DESCRIPTION OF EMBODIMENTS

Figure 1:
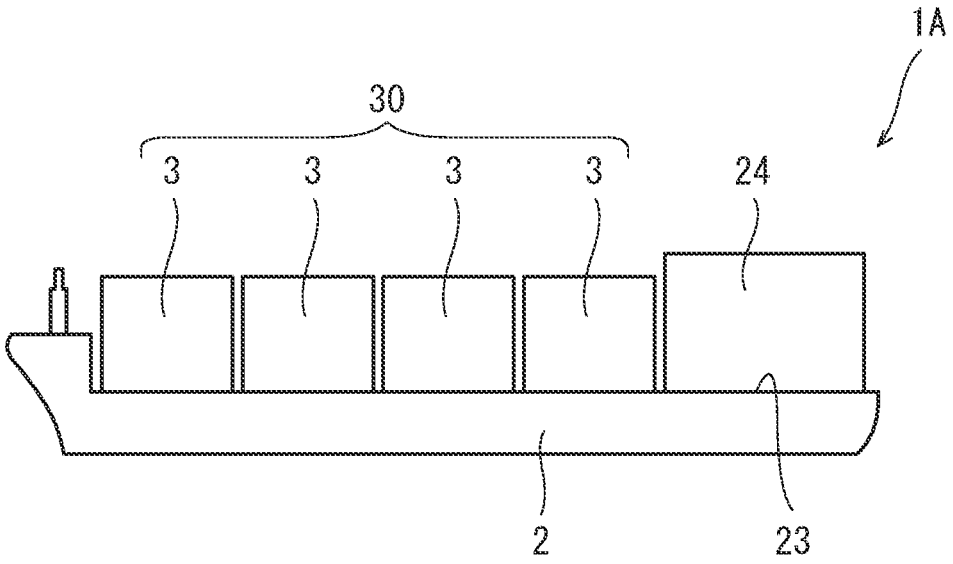
FIG. 1 is a side view of a ship including a first-use installation.
Figure 3:
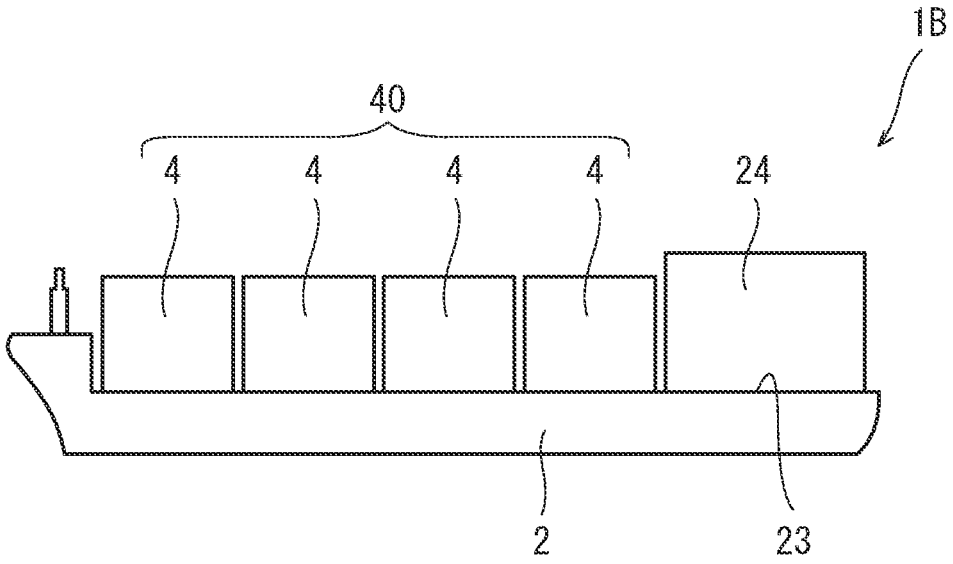
FIG. 3 is a side view of a ship including a second-use installation.

A hull-mounted installation conversion method according to one embodiment of the present disclosure includes: a first step of constructing a first-use installation 30 on a hull 2 as shown in FIG. 1; and a second step of constructing a second-use installation 40 on the hull 2 as shown in FIG. 3. That is, a ship 1A including the first-use installation 30 is obtained by the first step, and the ship 1A is remodeled into a ship 1B including the second-use installation 40 by the second step. In the case where the first step has been previously completed, the hull-mounted installation conversion method may include only the second step.

Figure 2:
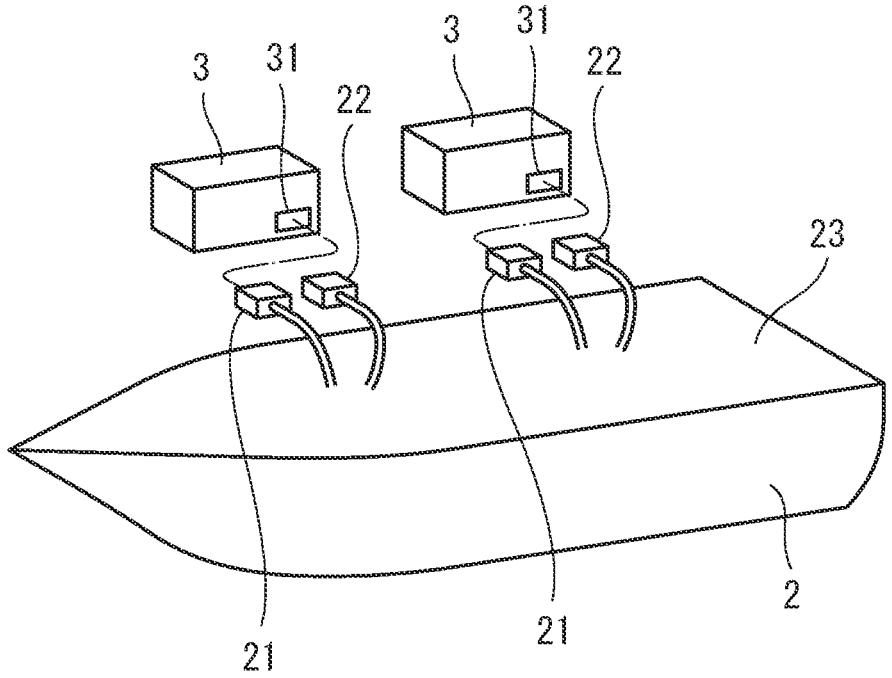
FIG. 2 is an exploded perspective view of the ship of FIG. 1.
Figure 4:
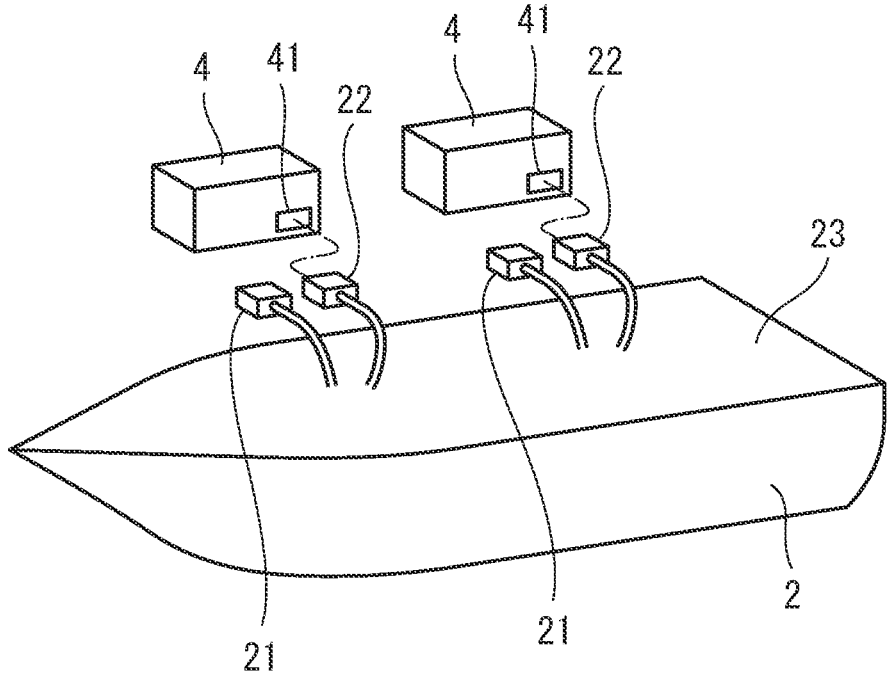
FIG. 4 is an exploded perspective view of the ship of FIG. 3.
Figure 5A:
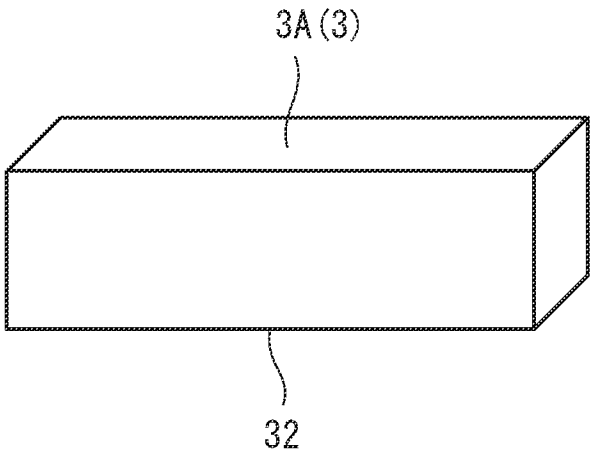
FIG. 5A is a perspective view of a first-use unit.
Figure 5B:
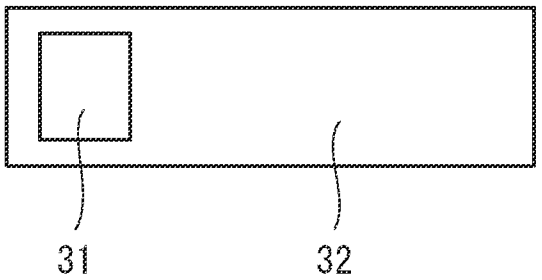
FIG. 5B is a bottom view of the first-use unit.
Figure 5C:
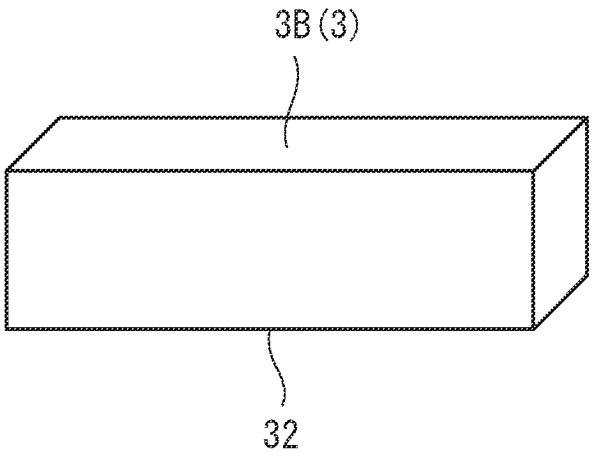
FIG. 5C is a perspective view of another first-use unit.
Figure 5D:
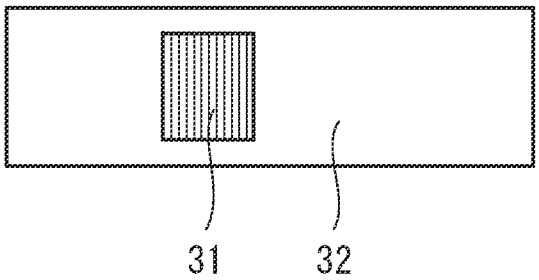
FIG. 5D is a bottom view of the other first-use unit.
Figure 6A:
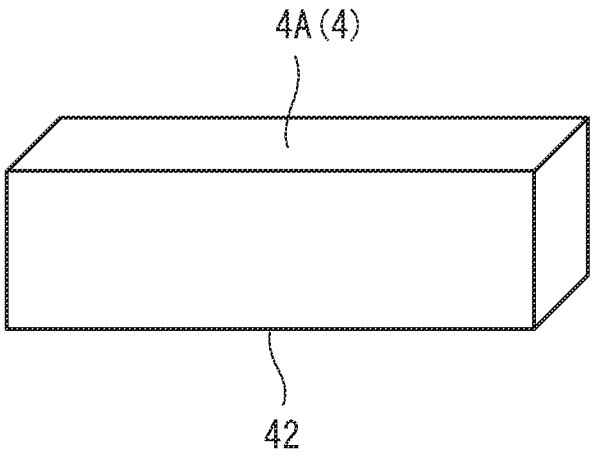
FIG. 6A is a perspective view of a second-use unit.
Figure 6C:
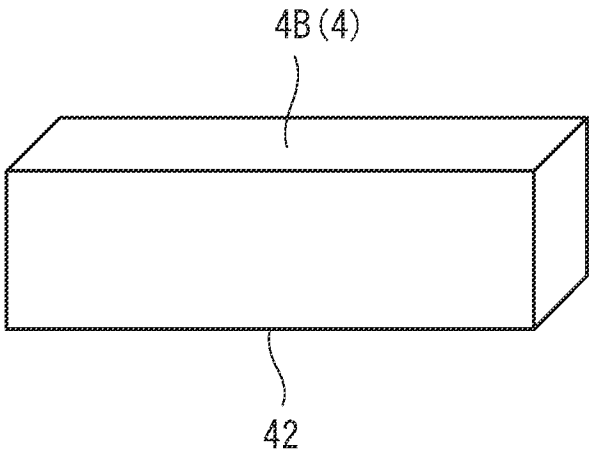
FIG. 6C is a perspective view of another second-use unit.
Figure 6B:
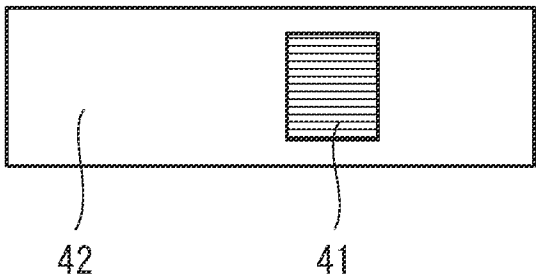
FIG. 6B is a bottom view of the second-use unit.
Figure 6D:
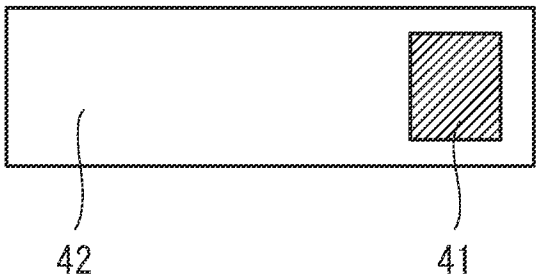
FIG. 6D is a bottom view of the other second-use unit.

Specifically, in the first step, first-use units 3 which constitute the first-use installation 30 are placed on the hull 2 as shown in FIGS. 1 and 2 to construct the first-use installation 30. In the second step, some or all of the first-use units 3 are removed from the hull 2 and then, as shown in FIGS. 3 and 4, second-use units 4 which constitute the second-use installation 40 are placed on the hull 2 to construct the second-use installation 40.

The hull 2 includes an upper deck 23, and the first-use and second-use units 3 and 4 are placed on the upper deck 23. Abridge 24 is located at the stem of the hull 2. The bridge 24 is not limited to being located at the stern and may be located at the bow.

In the present embodiment, the first-use units 3 are medical units, and the first-use installation 30 is a medical installation. As such, the ship 1A is a hospital ship. The second-use units 4 and the second-use installation 40 are not limited to particular kinds of units and installation. For example, the second-use units 4 are cruising units, and the second-use installation 40 is a cruising installation. In this case, the ship 1B is a luxury cruise ship.

With the configuration of the present embodiment, a hospital ship including a medical installation can be remodeled into a ship including another installation. Contrary to the present embodiment, the second-use units 4 may be medical units, and the second-use installation 40 may be a medical installation. In this case, a ship including an installation other than any medical installation can be remodeled into a hospital ship including a medical installation.

As shown in FIG. 2, the first-use units 3 include first unit-side connectors 31, respectively, and each of the first unit-side connectors 31 includes an interface for an infrastructure required by a corresponding one of the first-use units 3. Likewise, as shown in FIG. 4, the second-use units 4 include second unit-side connectors 41, respectively, and each of the second unit-side connectors 41 includes an interface for an infrastructure required by a corresponding one of the second-use units 4.

The hull 2 includes first hull-side connectors 21 connectable to the first unit-side connectors 31, respectively, and second hull-side connectors 22 connectable to the second unit-side connectors 41, respectively. The first hull-side connectors 21 and the second hull-side connectors 22 are connected to various pieces of equipment mounted on the hull 2 via flexible tubes or cables.

In the present embodiment, the first-use units 3 are classified into different types. For example, as shown in FIGS. 5A to 5D, the first-use units 3 include two types of first-use units 3A and 3B. All of the first-use units 3 may be of the same type.

Furthermore, in the present embodiment, each of the first-use units 3 is a container including an internal configuration corresponding to the type of the first-use unit 3. The first unit-side connector 31 of each of the first-use units 3 is at a location on a bottom surface 32 of the first-use unit 3, and the location of the first unit-side connector 31 differs according to the type of the first-use unit 3 (in FIG. 2, the first unit-side connectors 31 are depicted on side surfaces of the first-use units 3 for ease of understanding).

The first unit-side connector 31 need not be located on the bottom surface 32 of the first-use unit 3, but may be located, for example, on a side surface of the first unit 3.

As described above, the first-use units 3 are medical units in the present embodiment. For example, the medical units include a residence container, an isolation container, and a treatment container. Inside the residence container there are pieces of equipment required for daily life of a person (such as a bed and a stove burner). Inside the isolation container there are beds and pieces of equipment required for care of patients (such as an aspirator). Inside the treatment container there are medical instruments and medical drugs required for treatment of patients.

Examples of the infrastructure required by the residence container include electricity, gas, clean water, and water drainage. Examples of the infrastructure required by the isolation container include electricity, clean water, vacuum, and water drainage. Examples of the infrastructure required by the treatment container include electricity, clean water, oxygen, and water drainage.

The medical units may further include a caregiving container, a rehabilitation container, and an infection research container. Examples of the infrastructure required by the caregiving container and the rehabilitation container include electricity, gas, clean water, and water drainage. Examples of the infrastructure required by the infection research container include electricity, clean water, vacuum, and water drainage.

Figure 8:
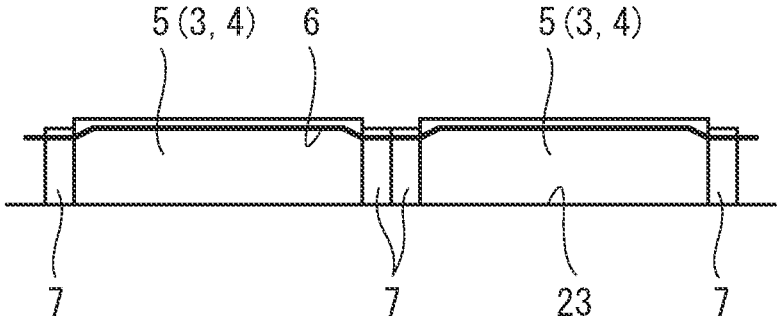
FIG. 8 is a side view of passageway containers.

The first-use units 3 may include a passageway container 5 as shown in FIG. 8 which is used as a passageway, irrespective of whether the first-use units 3 are medical units. That is, inside the passageway container 5 there are no large-sized pieces of equipment but only small-sized pieces of equipment such as a lighting instrument. For example, in the case where two passageway containers 5 are connected to each other, connection modules 7 each of which is in the form of bellows or the like may be located at both ends of each passageway container 5, and the connection modules 7 may be coupled to each other.

In the case where the first-use units 3 include the passageway container 5, a cable and/or a duct may, as shown in FIG. 8, be laid inside the passageway container 5 and along the ceiling of the passageway container 5. The cable is for flow of electric currents, and the duct is for flow of gas or water. Alternatively, the cable and/or duct may be laid along the bottom of the passageway container 5. In the case where the cable and/or duct is laid along the bottom of the passageway container 5, a partition board is located inside the passageway container 5 and above the cable and/or duct to form the floor of the passageway container 5.

In the present embodiment, all of the containers serving as the first-use units 3 are of the same size. The containers may be arranged in a plane on the upper deck 23 or arranged in stacks on the upper deck 23.

One or some of the containers may differ in size from the other containers. Alternatively, all of the containers may have different sizes. Two or more of the containers may be combined to constitute a single room. Furthermore, each of the first-use units 3 need not be a container but may be an open-type unit.

In the present embodiment, the second-use units 4 are classified into different types like the first-use units 3. For example, as shown in FIGS. 6A to 6D, the second-use units 4 include two types of second-use units 4A and 4B. All of the second-use units 4 may be of the same type.

Furthermore, in the present embodiment, each of the second-use units 4 is a container including an internal configuration corresponding to the type of the second-use unit 4. The second unit-side connector 41 of each of the second-use units 4 is at a location on a bottom surface 42 of the second-use unit 4, and the location of the second unit-side connector 41 differs according to the type of the second-use unit 4 (in FIG. 4, the second unit-side connectors 41 are depicted on side surfaces of the second-use units 4 for ease of understanding).

The second unit-side connector 41 need not be located on the bottom surface 42 of the second-use unit 4, but may be located, for example, on a side surface of the second-use unit 4.

For example, in the case where the second-use units 4 are cruising units, the cruising units include a leisure container, a workshop container, and a sport container. For example, inside the workshop container there are desks and chairs, and examples of the infrastructure required by the sport container include electricity, clean water, and water drainage.

Like the first-use units 3, the second-use units 4 may include the passageway container 5 used as a passageway. In this case, a cable and/or a duct may be laid inside the passageway container 5 and along the ceiling or the bottom of the passageway container 5.

In the present embodiment, all of the containers serving as the second-use units 4 are of the same size. The containers may be arranged in a plane on the upper deck 23 or arranged in stacks on the upper deck 23.

One or some of the containers may differ in size from the other containers. Alternatively, all of the containers may have different sizes. Two or more of the containers may be combined to constitute a single room. Furthermore, each of the second-use units 4 need not be a container but may be an open-type unit.

Figure 7:
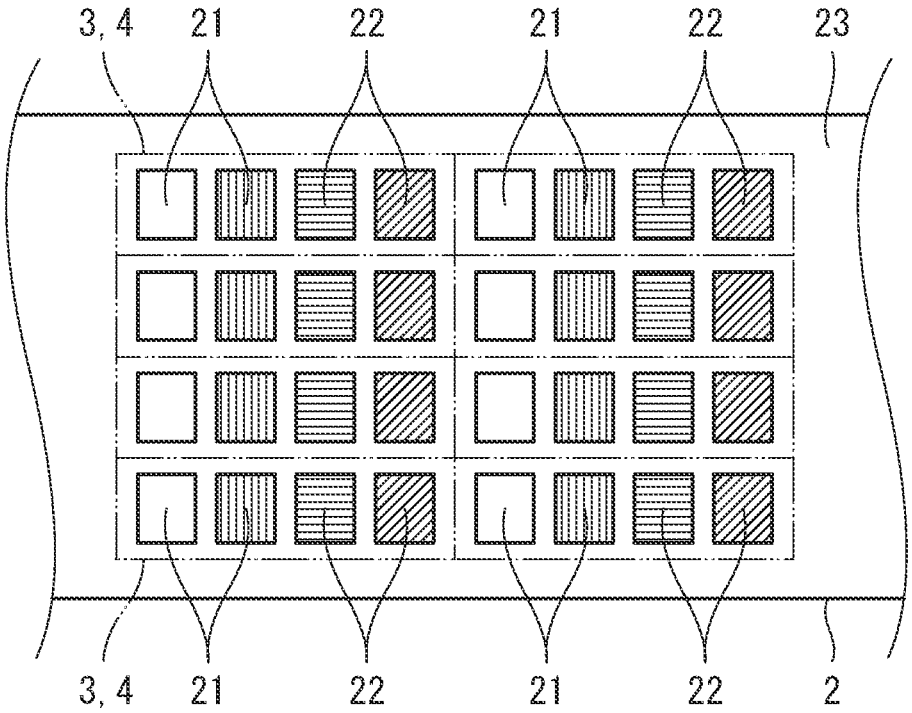
FIG. 7 is a plan view of a part of a hull in one embodiment of the present disclosure.

On the upper deck 23 of the hull 2, as shown in FIG. 7, there are distinct regions in each of which the first-use unit 3 or the second-use unit 4 is placed (i.e., areas each of which is occupied by a corresponding one of the units). The number of the first hull-side connectors 21 in each of the distinct regions is equal to the number of the types of the first-use units 3, and the number of the second hull-side connectors 22 in each of the distinct regions is equal to the number of the types of the second-use units 4. Furthermore, each of the first hull-side connectors 21 is located in correspondence with the first unit-side connector 31 the location of which differs according to the type of the first-use unit 3. Likewise, each of the second hull-side connectors 22 is located in correspondence with the second unit-side connector 41 the location of which differs according to the type of the second-use unit 4.

At least one of the types into which the first-use units 3 are classified and at least one of the types into which the second-use units 4 are classified may be the same. For example, one or some of the first-use units 3 and one or some of the second-use units 4 may be residence containers. Alternatively, one of the first-use units 3 and one of the second-use units 4 may be electricity generation units each of which includes an electricity generator. With this configuration, at least one of the first-use units 3 may be used as the second-use unit 4.

As described above, with the use of the hull-mounted installation conversion method of the present embodiment, the first-use installation 30 can be converted into the second-use installation 40 by replacing some or all of the first-use units 3 with the second-use units 4. Thus, a ship can be remodeled at a low cost and in a short period of time.

In the present embodiment, each of the first-use units 3 includes the first unit-side connector 31, each of the second-use units 4 includes the second unit-side connector 41, and the hull 2 includes the first hull-side connectors 21 and the second hull-side connectors 22. Thus, infrastructure system construction following placement of the first-use units 3 on the hull 2 can easily be performed, and infrastructure system construction following placement of the second-use units 4 on the hull 2 can also easily be performed.

Furthermore, in the present embodiment, the location of the first unit-side connector 31 differs according to the type of the first-use unit 3. Thus, the first hull-side connector 21 to be connected can be identified based on the location of the first unit-side connector 31. Additionally, the location of the second unit-side connector 41 also differs according to the type of the second-use unit 4. Thus, the second hull-side connector 22 to be connected can be identified based on the location of the second unit-side connector 41.

After the ship 1A (hospital ship) is obtained, the ship 1A may be moored to a wharf, and the ship 1A and the wharf may be flexibly connected to allow people to come and go between the ship 1A and the wharf. This enables the ship 1A to operate as a common hospital. In the event of a disaster such as an earthquake or a pandemic, hospitalized patients may be transferred to an onshore hospital, then the flexible connection may be cut off, and the ship 1A may be navigated to the disaster-or pandemic-affected area. With this ship operation method, the medical installation (first-use installation 30) of the ship 1A can be fully utilized in the disaster-or pandemic-affected area.

Although not shown, the hull 2 includes a propulsion engine (internal combustion engine) that drives a propulsion propeller. In the case of mechanical propulsion, the propulsion engine directly drives the propulsion propeller, while in the case of electric propulsion, the propulsion engine drives the propulsion propeller via an electricity generator and a motor. In the case of mechanical propulsion, the propulsion engine may drive not only the propulsion propeller but also the electricity generator.

The hull 2 may include an electricity connector for externally supplying electricity generated by the electricity generator driven by the propulsion engine. In general, the propulsion engine is scarcely used when the ship 1A is at anchor. However, in the case where the hull 2 includes the electricity connector, the propulsion engine can be operated in the ship 1A at anchor to sell the generated electricity. In the event of a disaster such as an earthquake, electricity can be supplied according to the needs after arrival at the disaster-affected area.

(Modifications)

The present disclosure is not limited to the embodiment described above, and various modifications can be made without departing from the gist of the present disclosure.

Figure 9:
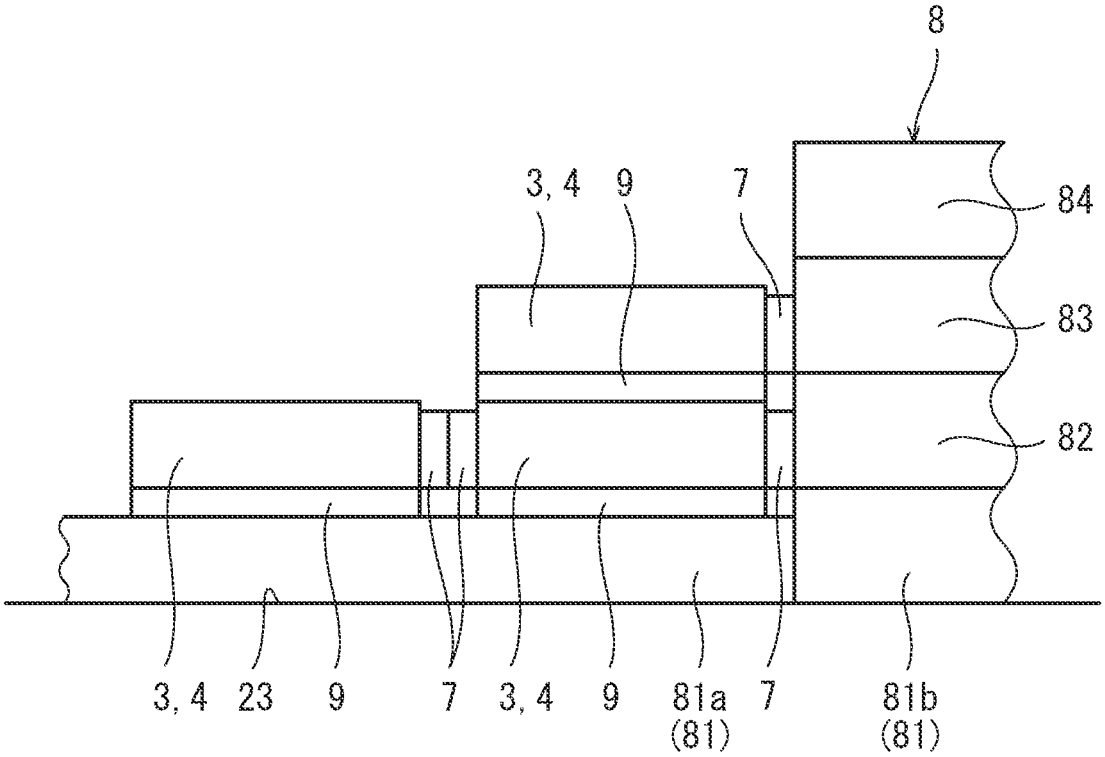
FIG. 9 shows an example where a hospital building is located on a hull.

For example, as shown in FIG. 9, a support base 9 may be mounted to at least one of the first-use units 3 and/or at least one of the second-use units 4. With this configuration, a cable or a duct can be laid within the support base 9, or the vertical location of the unit (3 or 4) can be adjusted to that of another installation by the support base 9.

For example, in the case where, as shown in FIG. 9, a hospital building 8 including first to fourth stories 81 to 84 is located as a permanent installation on the hull 2, the height of each of the second to fourth stories 82 to 84 is set to about 3 m. The first story 81 on the upper deck 23 includes a large-height portion 81*b* located under the second to fourth stories 82 to 84, and a small-height portion 81*a*. The large-height portion 81*b* has substantially the same height as the second to fourth stories 82 to 84, and the small-height portion 81*a* has a smaller height than the second to fourth stories 82 to 84. Thus, if the unit (3 or 4) with the support base 9 mounted thereto is placed on the small-height portion 81*a*, the level of the floor of the unit can be adjusted to the level of the floor of the second story 82 of the hospital building 8. Furthermore, the height of the units (3 or 4) is set to about 2.5 m to allow for overland transportation of the units. Thus, if the unit (3 or 4) with the support base 9 mounted thereto is placed on the unit (3 or 4) located on the small-height portion 81*a*, the level of the floor of the unit with the support base 9 mounted thereto can be adjusted to the level of the floor of the third story 83 of the hospital building 8. In FIG. 9, the connection modules 7 are located between the units (3 or 4) themselves and between the units and the hospital building 8.

Figure 10A:
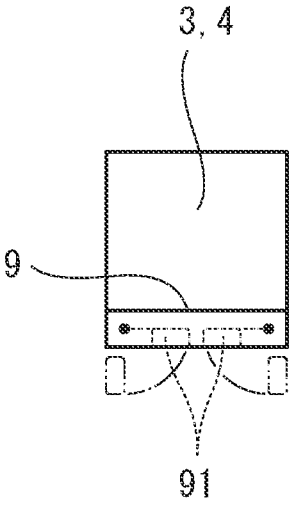
FIG. 10A is a front view of a support base including wheels and a unit with the support base mounted thereto.
Figure 10B:
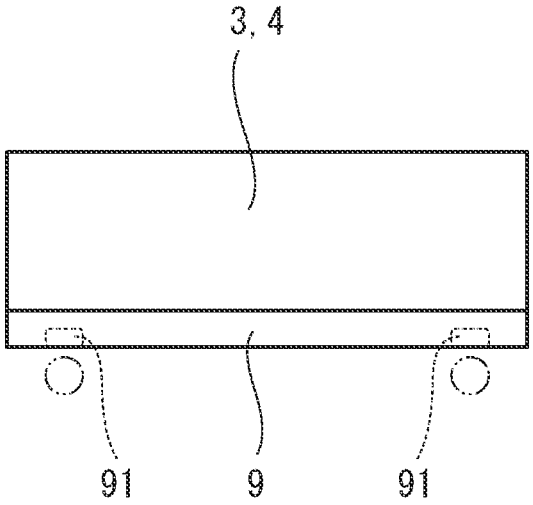
FIG. 10B is a side view of the support base and the unit.

In the case where the support base 9 is mounted to at least one of the first-use units 3 and/or at least one of the second-use units 4, the support base 9 may include wheels 91 as shown in FIGS. 10A and 10B. The wheels 91 are retracted in the support base 9 when the support base 9 is on the hull 2. In the example shown, each of the wheels 91 is pivotally movable between an in-use position where its axle extends horizontally and a retracted position where its axle extends vertically. Alternatively, the wheels 91 may be removed from the support base 9 when the support base 9 is on the hull 2. With this configuration, the unit (3 or 4) can easily be transported overland together with the support base 9.

SUMMARY

A hull-mounted installation conversion method of the present disclosure includes: removing some or all of first-use units from a hull, the first-use units being placed on the hull and constituting a first-use installation; and placing second-use units on the hull to construct a second-use installation after the removing of the first-use units.

With the above configuration, the first-use installation can be converted into the second-use installation by replacing some or all of the first-use units with the second-use units. Thus, a ship can be remodeled at a low cost and in a short period of time.

The first-use units may be medical units, and the first-use installation may be a medical installation. With this configuration, a hospital ship including a medical installation can be remodeled into a ship including another installation.

The second-use units may be medical units, and the second-use installation may be a medical installation. With this configuration, a ship including an installation other than any medical installation can be remodeled into a hospital ship including a medical installation.

The first-use units may include first unit-side connectors, respectively, each of the first unit-side connectors including an interface for an infrastructure required by a corresponding one of the first-use units, the second-use units may include second unit-side connectors, respectively, each of the second unit-side connectors including an interface for an infrastructure required by a corresponding one of the second-use units, and the hull may include first hull-side connectors connectable to the first unit-side connectors, respectively, and second hull-side connectors connectable to the second unit-side connectors, respectively. With this configuration, infrastructure system construction following placement of the first-use units on the hull can easily be performed, and infrastructure system construction following placement of the second-use units on the hull can also easily be performed.

The first-use units may be classified into different types, each of the first-use units may be a container including an internal configuration corresponding to the type of the first-use unit, the first unit-side connector of each of the first-use units may be at a location on a bottom surface of the first-use unit, and the location of the first unit-side connector may differ according to the type of the first-use unit. With this configuration, the first hull-side connector to be connected can be identified based on the location of the first unit-side connector.

The second-use units may be classified into different types, each of the second-use units may be a container including an internal configuration corresponding to the type of the second-use unit, the second unit-side connector of each of the second-use units may be at a location on a bottom surface of the second-use unit, and the location of the second unit-side connector may differ according to the type of the second-use unit. With this configuration, the second hull-side connector to be connected can be identified based on the location of the second unit-side connector.

The first-use units may be classified into different types, the second-use units may be classified into different types, and at least one of the types into which the first-use units are classified and at least one of the types into which the second-use units are classified may be the same. With this configuration, at least one of the first-use units can be used as the second-use unit.

For example, the first-use units and/or the second-use units may include a passageway container used as a passageway. In this case, a cable and/or a duct may be laid inside the passageway container and along a ceiling or a bottom of the passageway container.

A support base may be mounted to at least one of the first-use units and/or at least one of the second-use units. With this configuration, a cable or a duct can be laid within the support base, or the vertical location of the unit can be adjusted to that of another installation by the support base.

The support base may include wheels, and the wheels may be retracted in the support base or removed from the support base when the support base is on the hull. With this configuration, the unit can easily be transported overland together with the support base.

The invention claimed is:

1. A hull-mounted installation conversion method comprising:

removing some or all of first-use units from a hull, the first-use units being placed on the hull and constituting a first-use installation; and placing second-use units on the hull to construct a second-use installation after the removing of the first-use units, wherein the first-use units include first unit-side connectors, respectively, each of the first unit-side connectors including an interface for an infrastructure required by a corresponding one of the first-use units, the second-use units include second unit-side connectors, respectively, each of the second unit-side connectors including an interface for an infrastructure required by a corresponding one of the second-use units, the hull includes first hull-side connectors connectable to the first unit-side connectors, respectively, and second hull-side connectors connectable to the second unit-side connectors, respectively, the first-use units are classified into different types, each of the first-use units is a container including an internal configuration corresponding to the type of the first-use unit, the first unit-side connector of each of the first-use units is at a location on a bottom surface of the first-use unit, the location of the first unit-side connector differs according to the type of the first-use unit, and the method further comprises connecting each type of the first-use units to the hull by aligning each respective first unit-side connector, located at a type-specific position on the bottom surface, with a matching location of only one of the first hull-side connectors in a distinct region, thereby establishing type-specific infrastructure connection based on positions of the respective first unit-side connectors relative to the first hull-side connectors.

2. The hull-mounted installation conversion method according to claim 1, wherein the first-use units are medical units, and the first-use installation is a medical installation.

3. The hull-mounted installation conversion method according to claim 1, wherein the second-use units are medical units, and the second-use installation is a medical installation.

4. The hull-mounted installation conversion method according to claim 1, wherein the second-use units are classified into different types, each of the second-use units is a container including an internal configuration corresponding to the type of the second-use unit, the second unit-side connector of each of the second-use units is at a location on a bottom surface of the second-use unit, and the location of the second unit-side connector differs according to the type of the second-use unit.

5. The hull-mounted installation conversion method according to claim 1, wherein at least one of the types into which the first-use units are classified and at least one of the types into which the second-use units are classified are the same.

6. The hull-mounted installation conversion method according to claim 1, wherein the first-use units and/or the second-use units include a passageway container used as a passageway.

7. The hull-mounted installation conversion method according to claim 6, wherein a cable and/or a duct is laid inside the passageway container and along a ceiling or a bottom of the passageway container.

8. The hull-mounted installation conversion method according to claim 1, wherein a support base is mounted to at least one of the first-use units and/or at least one of the second-use units.

9. The hull-mounted installation conversion method according to claim 8, wherein the support base includes wheels, and the wheels are retracted in the support base or removed from the support base when the support base is on the hull.

* * * * *